United States Patent [19]

Garner

[11] Patent Number: 4,581,885

[45] Date of Patent: Apr. 15, 1986

[54] MANUFACTURE OF TELECOMMUNICATIONS CABLE CORE UNITS

[75] Inventor: John N. Garner, Kingston, Canada

[73] Assignee: Northern Telecom Limited, Montreal, Canada

[21] Appl. No.: 637,594

[22] Filed: Aug. 3, 1984

[51] Int. Cl.[4] ..... H01B 13/04

[52] U.S. Cl. ..... 57/314; 57/6; 57/59; 57/66; 57/293

[58] Field of Search ..... 57/6, 12, 59, 60, 66, 57/311, 314, 293

[56] References Cited

U.S. PATENT DOCUMENTS 3,001,353 9/1961 Lapsley ..... 57/60 X

*Primary Examiner*—John Petrakes

*Attorney, Agent, or Firm*—R. J. Austin

[57] ABSTRACT

Changing relative positions of conductor pairs along a telecommunications cable core by passing the unstranded pairs, as they approach the core unit forming means, through individual guides which are reciprocally moved across a feedpath for the pairs, the guides being disposed in series along the feedpath with each guide aligned for unobstructed passage of its conductor unit along the feedpath. In this construction, means to reciprocate each guide overlaps those of other guides, thereby reducing the total height of the apparatus.

15 Claims, 10 Drawing Figures

MANUFACTURE OF TELECOMMUNICATIONS CABLE CORE UNITS

This invention relates to the manufacture of telecommunications cable core units.

A telecommunications cable is constructed with a core comprising one or more core units, each having a multiplicity of twisted units of conductors, each unit conventionally being a twisted pair of conductors. A core may be formed as a single core unit of twisted pairs, e.g. 50 or 100 pairs, or larger cores, i.e. up to 3,600 twisted pairs, comprises a plurality of core units. The twisted pairs are stranded together to form a core unit with the conductors of each pair twisted together with a predetermined lead to the twist, i.e. the distance taken along the pair for each conductor to complete a single revolution along its path. This distance will be referred to in this specification as the "twist lay" of a pair. There are different twist lays provided for the twisted pairs in a core unit with a pair having a particular twist lay being adjacent to other pairs of different twist lays. Care is taken, so far as is practicable, to ensure that pairs of equal or similar twist lays are separated from each other. The reason for this arrangement is to attempt to maximize the communications performance of the cable, e.g. to lessen pair-to-pair capacitance unbalance, to reduce crosstalk between pairs and to lower the coefficient of deviation of mutual capacitance of pairs in the cable.

In a conventional core unit, the twisted conductor pairs retain their positions relative to other pairs, within certain limits. However, it is recognized that the pair-to-pair capacitance unbalance and crosstalk between pairs is dependent to a large degree upon the distance of the two pairs from one another. To reduce the pair-to-pair capacitance unbalance and to improve crosstalk, suggestions have been made to move the conductor pairs relative to one another as they progress towards a stranding machine for stranding them into a core unit so that in the finished core unit, the conductor pairs change in relative positions and distances apart. In a suggested method for changing the relative positions of conductor pairs as they move towards the stranding machine, the conductor pairs enter a guide arrangement which comprises a system of horizontal guides movable horizontally and located in vertically tiered fashion. The pairs are distributed throughout the tiers and relative horizontal movement of the guides changes the relative positions of the pairs as they move downstream. This method was first suggested by Sigurd Norblad of Telefonaktiebolaget LM Ericsson, in a paper entitled "Capacitance Unbalance Telecommunications Networks" read before the International Wire and Cable Symposium in 1971. In this method, the conductor pairs need to be controllably arranged together in their changing relative positions preparatory to their passage into a closing die, in which they are drawn together to form the core unit. Controllable arrangement of the pairs should be possible by passing them from their various positions partly around rollers. However, extreme height of the Ericsson machine, even for changing positions of twenty-five pairs, is such that severe change in angles of feedpaths of some of the conductor pairs is required for them to pass around the rollers. Such a severe change can cause damage to either the conductors or to their insulation, particularly if the insulation is made from pulp, and will also induce large tension variations between conductor pairs.

The present invention concerns a method and apparatus for making core units involving changing the relative positions of conductor units before they are brought together to form a core unit and in which the change in angle between conductor units is minimized as they move onto rollers to controllably arrange the conductor units.

Accordingly, the present invention provides apparatus for forming a core unit from telecommunications conductor units, each formed of twisted together insulated conductors and in which the relative positions of the conductor units are changed along the core unit, the apparatus comprising in order, downstream along a feedpath for the units:

guide means to ensure that conductor units are not stranded together as they move downstream from the guide means;

a plurality of position changing means for conductor units, each position changing means for changing the position of a conductor unit across the feedpath relative to other conductor units, and each position changing means comprising a guide and means to reciprocally move the guide along a path across the feedpath, the position changing means disposed in series with one another along the feedpath with their reciprocating means overlapping one another in a view taken along the feedpath and the arrangement of position changing means being such that each guide is aligned for unobstructed passage of a conductor unit as it moves along the feedpath; and a core unit forming and take-up means to draw the conductor units together to form the core unit.

In the above apparatus according to the invention, the overlapping arrangement of the position changing means ensures that the dimensions of the apparatus are reduced to a minimum in the direction of the separation of the conductor units, these dimensions sufficient to enable the unobstructed alignment of each guide for passage of its respective conductor unit. This construction thereby allows for the angle subtended between the furthest apart of the conductor units and arrangement rollers to be reduced to a minimum.

The angle is further decreased when the position changing means are arranged in groups. For instance, in one construction, each reciprocating means comprises an endless moving means having its associated guide secured to one flight of the moving means and all of the guide carrying flights of the moving means are non-aligned to provide the unobstructed passage of the conductor units. In a case where the guide carrying flights are disposed substantially horizontally, then the two groups of endless means are disposed vertically one above the other, and the guide carrying flights in each group are vertically displaced progressively in one direction from one endless moving means to the next. In this two group arrangement, if the lower group has the guide carrying flights at the tops of the moving means, and the guide carrying flights in the upper group are disposed at the bottoms of the moving means, then the flights are preferably disposed so as to approach each other progressively downstream from moving means to moving means. Thus, the guides of the two groups which are furthest apart lie at the upstream ends of the groups and are furthest removed from the arrangement rollers. Thus, the angle subtended between conductor units passing through these guides and the rollers is reduced to a minimum.

Embodiments of the invention will now be described, by way of example, with reference to the accompanying drawings, in which.

Figure 1:
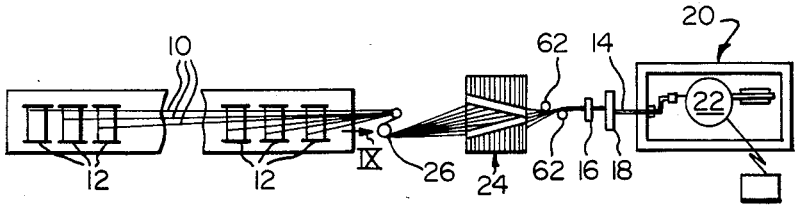
FIG. 1 is a side elevational view of an apparatus according to a first embodiment for forming a core unit from conductor pairs.

In the first embodiment as shown in FIG. 1, twenty-five conductor pairs 10, each formed from two twisted together individually insulated conductors, are drawn from twenty-five reels 12 of the conductor pairs, in conventional fashion, for forming into a core unit 14. The core unit 14 is formed at the downstream end of the apparatus by passing the conductor pairs through a closing die 16 which draws the conductor pairs together, and a binding head 18 at which position a binding material is closed around the drawn together conductor pairs to hold them together in conventional manner.

A stranding machine 20 forms part of a core unit forming and take-up means which also includes the closing die 16 and binding head 18. The stranding machine is of conventional construction and comprises a motor driven core unit take-up reel 22. As the stranding machine structure is conventional, no further description is required.

Figure 9:
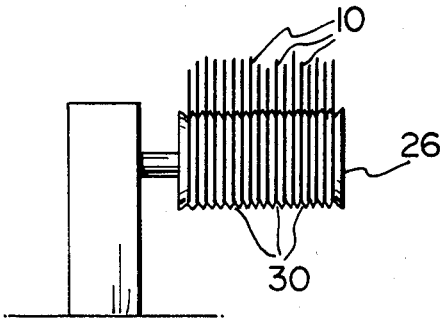
FIG. 9 is a view in the direction of arrow IX in FIG. 1.

Upstream from the closing die 16 is a position changing means 24 for conductor pairs. Further upstream from the position changing means is a guide means to ensure that conductor units are not stranded together as they move downstream from the guide means. This guide means comprises a roller 26 which is freely rotatably mounted upon a machine frame 28 (see FIG. 9) and the roller is provided with a plurality of annular grooves 30, one for each conductor pair. As may be seen from FIGS. 1 and 9, the conductor pairs are passed from the reels 12 towards the position changing means 24 by disposing each conductor pair in its own individual groove 30 so as to maintain the conductor pairs separate from one another as they approach the position changing means 24.

Figure 2:
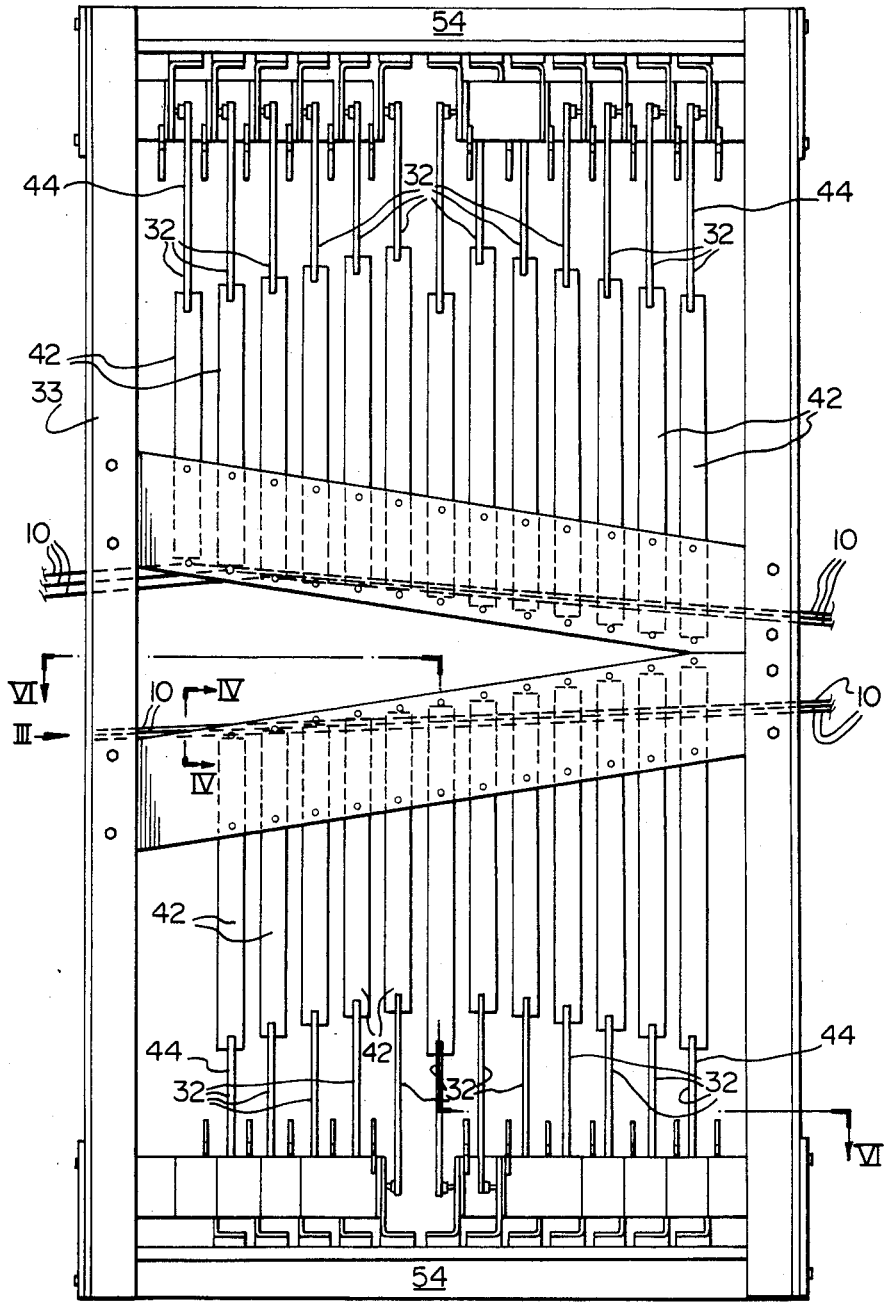
FIG. 2 is a side elevation of a position changing means for conductor pairs of the apparatus and on a larger scale than shown in FIG. 1.
Figure 3:
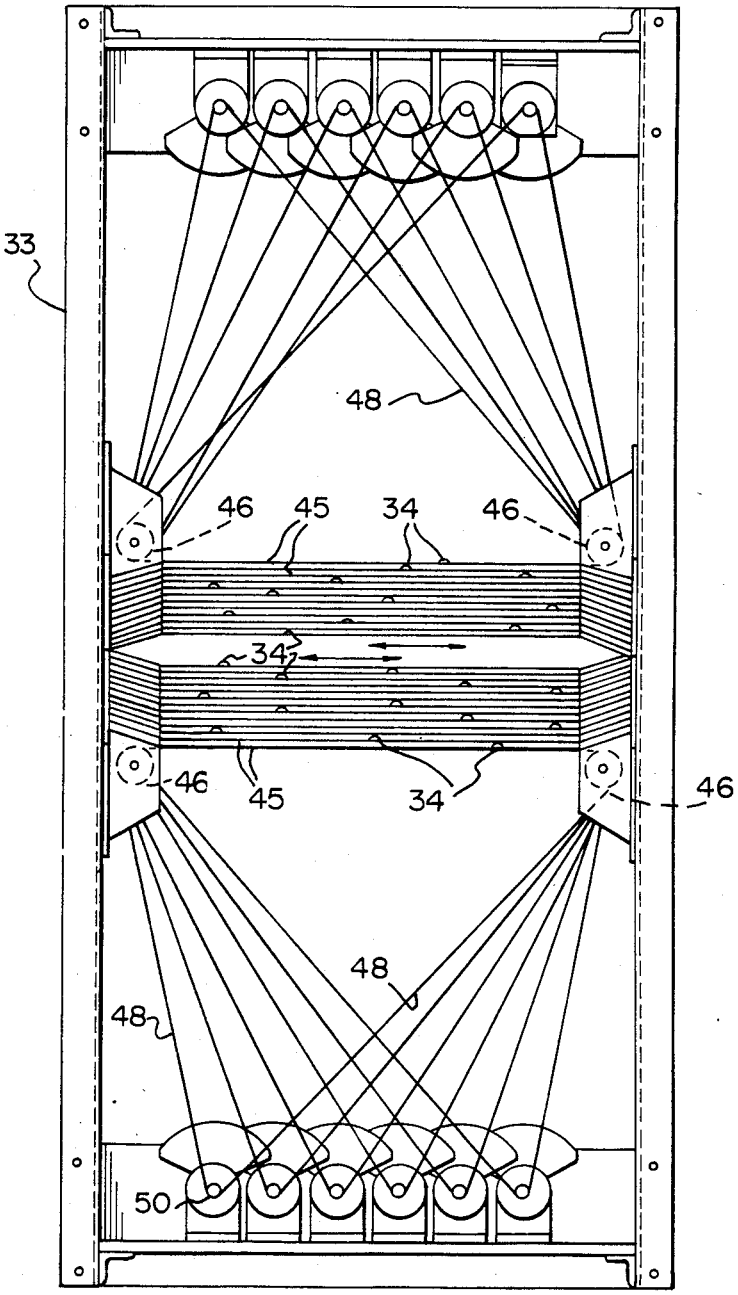
FIG. 3 is a view of the apparatus in the direction of arrow III in FIG. 2.

As shown by FIGS. 2 and 3, a plurality of position changing means 32 are provided for the conductor pairs, one position changing means for each pair. The position changing means are all housed within the straight sided frame 33. As shown by FIGS. 2 and 3, the position changing means are disposed in two groups, one vertically above the other, with the position changing means in each group lying in series with one another along the feedpath for the conductor pairs.

Figure 4:
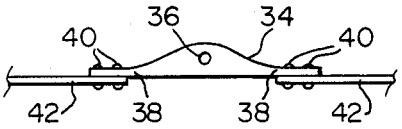
FIG. 4 is a cross-sectional view of the apparatus along line IV—IV in FIG. 2 and on a larger scale.
Figure 5:
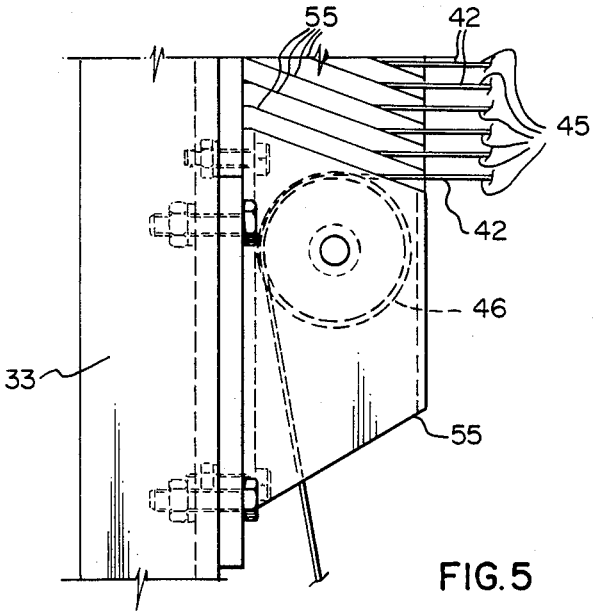
FIG. 5 is an end view of a detail in the same direction as FIG. 3 and on larger scale.
Figure 6:
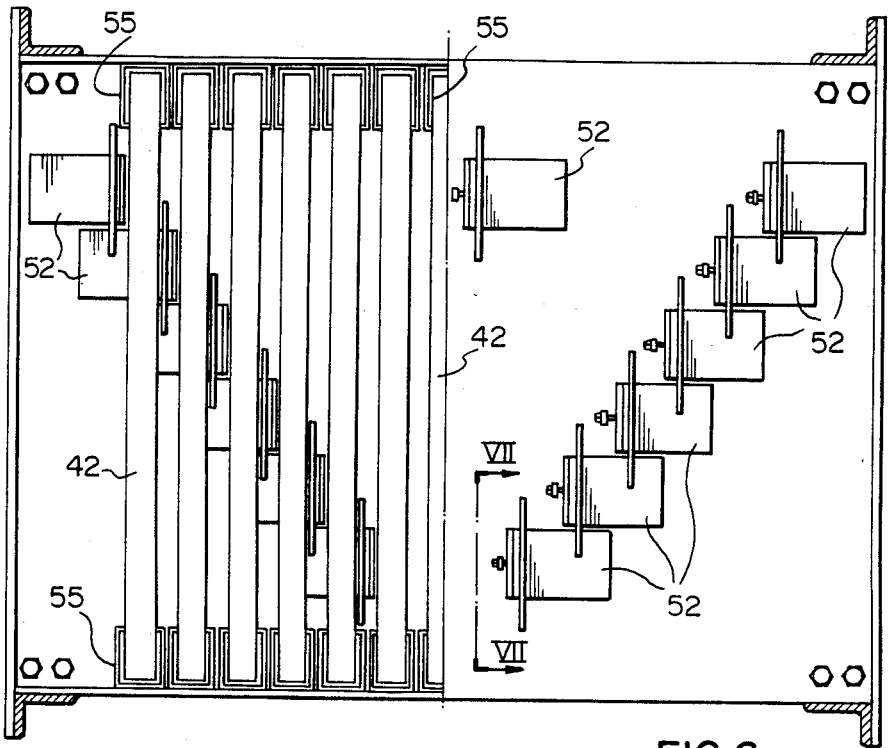
FIG. 6 is a cross-sectional view taken along line VI—VI in FIG. 2 and on a larger scale than FIG. 4.

Each position changing means comprises a guide 34 for a conductor pair (see FIG. 4). Each guide has a guide passage 36 and is formed with two side wings 38 by which it is attached, for instance, with rivets 40 to an endless moving means of a reciprocating means for the guide, the endless moving means comprising a flat plastics belt 42 through which the rivets 40 pass. The endless moving means also comprises a chain 44 which extends between ends of the belt 42, as shown by FIG. 6. Each endless moving means has a horizontal flight 45 formed by the belt 42 and carrying the associated guide 34, the belt mounted around two pulleys 46 at the sides of the machine frame to proceed as two flights 48 towards a sprocket 50 around which the chain 44 passes for reasons to be described. As shown by FIGS. 2 and 3, the two groups of position changing means are mounted with their reciprocating means overlapping one another in a view taken along the feedpath (see FIG. 3 particularly) and the arrangement is such that each guide is aligned with an unobstructed passage for its conductor pair as the pair moves along the feedpath. This clear passage for movement of a conductor pair through each guide is achieved by disposing the horizontal flights 45 of the belts 42 of each group of position changing means at different vertical levels, as shown by FIG. 3. In practice, with the lower group, the horizontal flights are displaced progressively vertically upwards from one position changing means to the next in a downstream direction of the feedpath by locating the pulleys upwardly from each position changing means to the next on supports 55. This is shown in the larger scale detail of FIG. 5. In contrast, the horizontal flights of the upper group are displaced progressively vertically downwards in a downstream direction of the feedpath. In fact, the arrangement is such that, as shown by FIG. 2, the horizontal flights of the two groups oppose each other across the feedpaths and approach each other progressively in a downstream direction along the feedpath. The advantage of this will be discussed below. Hence, as can be seen from above, the distance apart of the uppermost and lowermost guides is minimized by the fact that the guides are displaced vertically by a minimal amount, which merely ensures that each of the guides is unobstructed for passage of its conductor pair. As the reciprocating means of the position changing means in each group overlap from one end of the group to the other, then the height is not increased unduly by the position changing means. This minimal displacement for unobstructed view of the guides is shown in FIG. 3, in which the guides are clearly unobstructed by horizontal flights of the belts.

As will now be described, each reciprocating means is operable to move its guide independently of the movement of other guides. To allow for this independent movement, each position changing means is provided with its own individual drive means in the form of a reversible stepper motor 52 (FIGS. 2 and 3). All of the stepper motors 52 are mounted remotely from the horizontal flights by being attached to upper and lower panels 54 of the machine stand. Each motor is directly drivably connected to a sprocket 50. As the succeeding changing means are closely adjacent to one another, then it is necessary for the motors 52 to be displaced from one another laterally of the feedpath, as shown in FIG. 6, to provide space for them to be mounted. As a result of this and the vertical displacement of pulleys 46, the path followed by each of the endless moving means in each group is different from the others, as shown by FIG. 3. The motors 52 may be drivable at the same speed as each other, whereby the guides 34 move along their horizontal flights at the same speed but out of phase with each other. However, in this embodiment, the drive motors are driven at speeds which are slightly different from each other, so that the positional relationship of all of the guides is continuously changing while reducing the possibility of a set pattern of novement of the guides 34.

Figure 7:
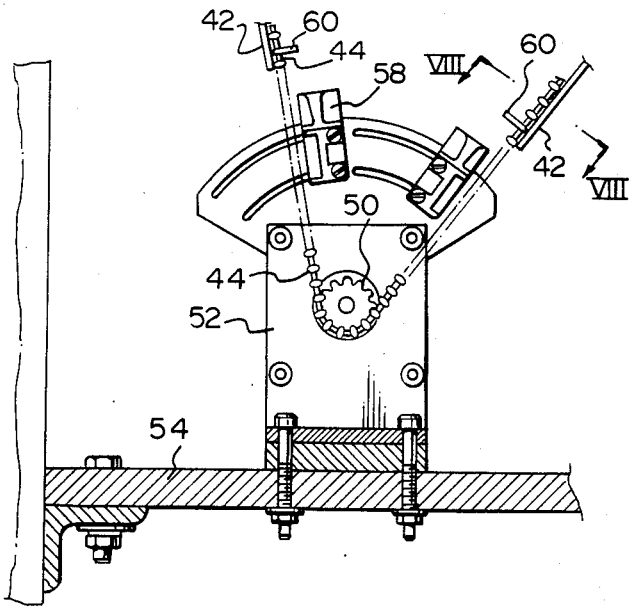
FIG. 7 is a cross-sectional view along line VII—VII in FIG. 6 and on a larger scale.
Figure 8:
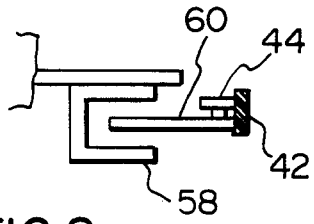
FIG. 8 is a cross-sectional view along line VIII—VIII in FIG. 7.

Each drive motor 52 is provided with a reversing means so as to cause the belts 42 to reciprocate, thereby moving the guides from side to side of the machine stand. As shown by FIGS. 7 and 8, the reversing means for each direction of movement of the belts 42 comprises a magnetic field producing means in the form of a magnet (not shown) carried in one leg of a U-shaped head 58, the other leg carrying a magnetic field receiving means in the form of a coil (not shown) affected by inductance of the magnetic field created by the magnet. Each coil sends signals into an electrical circuit (not shown), the strength of the signals dependent upon the strength of the magnetic field induced in the coil and produced by the magnet. The reversing means also comprises a magnetic field interference means for each direction of movement of the belt 42. This interference means comprises a trigger device in the form of an arm 60 which is secured to and projects sideways from the chain 44 so as to be aligned with the gap in the head 58, as shown by FIG. 8. The position of the arm 60 on the chain on each flight 48 of the endless moving means is dictated by the position required to influence the magnetic field, i.e. by location within the gap, when the guide is at the end of its movement on the horizontal flight of its belt in the appropriate direction.

In use of the apparatus described above, the conductor pairs 10 are fed to the position changing means in the manner described with reference to FIG. 1. Each conductor pair, upon reaching the machine frame 24, is passed through a respective guide 34 and proceeds from there around two in-series arrangement rollers 62 prior to passing through the closing die 16. As the conductor pairs move along their feedpaths in spaced positions through the position changing means, the independent motors 52 rotate at their own fixed speed, possibly controlled by computer, so as to move the belts 42 to reciporcate the guides horizontally. During this movement, each of the conductor pairs passes both over and under horizontal flights of the belts 42 of position changing means in its own group, as shown by FIG. 2. In this figure, the paths of three conductor pairs 10 only are shown for clarity. Movement of the guides independently of other guides continuously changes the relative positions of all of the conductor pairs as they pass through the position changing means. Thus, as the conductor pairs pass around the arrangement rollers 62, their positions in the plane of contact with the rollers are dependent upon the positions of the pairs at any particular time moving through the guides 34. Hence, the relative positions of the conductor pairs on the roller also continuously change, thereby changing the relative positions in a continuous fashion in the pairs as they enter the closing die 16. Hence, the position changing means described above is effective in providing constant change in relative positions of the conductor pairs in the finished core unit, which is wound onto the drum in the stranding machine.

A main advantage with the apparatus according to the invention and as described in the embodiment is that because the reciprocating means of the position changing means overlap each other, then the total height of the position changing means is minimized. In the particular construction which has been described, the height of the machine stand for changing position of the twenty-five conductor pairs is approximately 48 inches and the width is approximately 20 inches, with the depth along the feedpath being of the order of approximately 30 inches. Also, as the horizontal flights of the belts 42 are displaced only sufficiently to enable each of the guides to be unobstructed for the passage of its conductor pair, then the height between uppermost and lowermost guides is minimized. This distance, i.e. at the upstream end of the two groups of position changing means, is approximately 7 inches. Because of this and as the guide means of the two groups approach each other in a downstream direction of the feedpath, then the uppermost and lowermost guides are furthest from the two arrangement rollers 62 so that the angle subtended between the conductor pairs from the guides to the rollers is minimized. On the other hand, if the positions of the guides were reversed in the downstream direction so that the guides of the two groups which were furthest apart were at the downstream end of the machine frame, then a greater angle would be produced between the conductor pairs passing through those guides and the rollers 62.

It follows that the apparatus according to the invention and as described in the embodiment produces an arrangement for changing positions of conductor pairs in which the vertical height across the pairs in the position changing means is minimized, thereby reducing any tendency for insulation to be damaged by the arrangement rollers. Also, the minimized angle subtended between the conductor pairs and the arrangement rollers serves to minimize tension variation between the pairs.

Figure 10:
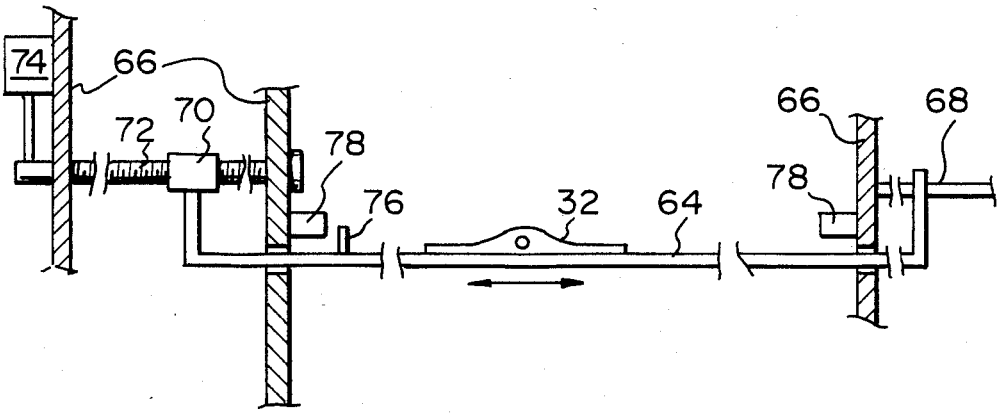
FIG. 10 is a view of features of a second embodiment.

In a second embodiment (FIG. 10) in which the two flights 48 of each of the belts 42 is avoided, thereby decreasing the height of the position changing means from that discussed above, each reciprocating means comprises a rigid member or bar 64 which extends across the feedpath for the conductor pairs and carries a guide 32 of similar construction to that described in the first embodiment. The guide 64 depends from two upwardly extending ends 66, one of the ends having an aperture to slidably receive a mounting spindle 68 secured to the machine frame. The other end 66 is provided with a nut 70 which is in screw-threaded engagement with a screw-threaded shaft 72, which is rotatable in the machine frame and is drivable, possibly through gearing, by an electric stepping motor 74. The connection between the motor and the spindle 72 is shown diagrammatically. The motor 74 is reversible and rotation in either direction moves the bar 64 in the appropriate direction through the screw-threaded shaft and nut. Reversing means is provided for moving the bar 64 in the opposite direction upon limit of movement in either direction. This reversing means comprises at each end of the bar, a magnetic field interrupter arm 76 (one only being shown) which moves with the bar to interfere with the magnetic field produced by a magnet provided in one leg of a head 78. The heads 78 are mounted upon the frame at each end of the bar. These heads are of the same construction as described in the first embodiment and include, in addition to the magnet, a coil in the other leg of the head for sensing when the magnetic field is interrupted by the presence of the arm 76 in the gap of the head. As discussed with regard to the first embodiment, upon the coil sensing the presence of the arm, a signal produced results in the drive of the motor 74 being reversed to move the bar 64 in the opposite direction.

What is claimed is:

1. Apparatus for forming a core unit from telecommunications conductor units, each formed of twisted together insulated conductors and in which the relative positions of the conductor units are changed along the core unit, the apparatus comprising in order, downstream along a feedpath for the core unit:

guide means to prevent conductor units from stranding together as they move downstream from the guide means;

a plurality of position changing means for conductor units, each position changing means for changing the position of a conductor unit across the feedpath relative to other conductor units and each position changing means comprising a guide and means to reciprocally move the guide along a path across the feedpath, the position changing means disposed in series with one another along the feedpath, with their paths of movement substantially parallel to one another and with their reciprocating means overlapping one another in a view taken along the feedpath and with the arrangement of position changing means being such that each guide is disposed for unobstructed passage of a conductor unit as it moves along the feedpath; and a core unit forming and take-up means to draw the conductor units together to form the core unit.

2. Apparatus according to claim 1, wherein each reciprocating means is operable to move its guide independently of the movement of other guides.

3. Apparatus according to claim 1, wherein each reciprocating means comprises an endless moving means having its associated guide secured thereto and reciprocally movable along one flight of the moving means, said one flight of the moving means of different position changing means being non-aligned to provide the unobstructed passage of the conductor units.

4. Apparatus according to claim 3, wherein each endless moving means is provided with an individual drive means.

5. Apparatus according to claim 4, wherein the endless moving means of different position changing means are movable at different relative speeds by the drive means.

6. Apparatus according to claim 3, wherein each endless moving means is provided with an individual reversible drive motor.

7. Apparatus according to claim 6, wherein each drive motor is drivable at a speed which is independent of the speeds of other motors.

8. Apparatus according to claim 6, wherein reversing means is provided for each drive motor, operation of each reversing means to reverse the direction of its drive motor dependent upon the position of the associated guide.

9. Apparatus according to claim 8 wherein, for each direction of movement of each endless moving means, the associated reversing means comprises a magnetic field producing means, a magnetic field receiving means in fixed position relative to the producing means to be influenced by a characteristic of the field, and a magnetic field interference means, movement of the endless moving means effecting simultaneous relative movement of the producing and receiving means on the one hand, and the interference means on the other to locate the interference means between the producing and receiving means when the moving means is at the limit of movement in said direction thereby to change the characteristic of the field at the receiving means, said receiving means operable upon said change in characteristic to initiate a control signal to reverse the direction of rotation of the drive motor.

10. Apparatus according to claim 8, wherein said one flight of successive endless moving means extends substantially horizontally and in different vertical positions.

11. Apparatus according to claim 10, wherein the endless moving means are disposed in at least two groups, one vertically above the other, with said one flight in each group extending substantially horizontally and vertically displaced progressively in one direction from one endless moving means to the next.

12. Apparatus according to claim 11, wherein there are two groups of endless moving means disposed vertically one above the other, with said first flight of each group disposed at the side of the group closest to the other and with the first flights of the two groups progressively closer together from moving means to moving means in a downstream direction along the feedpath.

13. Apparatus according to claim 1, wherein each reciprocating means comprises a rigid member extending across and movable along a fixed path across the feedpath and having its associated guide means secured thereto, and an individual drive means to reciprocally move the rigid member across the feedpath.

14. Apparatus according to claim 13, wherein each individual drive means comprises a rotatable drive spindle formed with a screw thread, reversible means to rotate the spindle and a driven screw-threaded member engaged with the spindle and secured to the associated rigid member to effect movement of the screw-threaded member and rigid member in one direction across the feedpath upon rotation of the drive spindle in the appropriate direction.

15. Apparatus according to claim 13, wherein each reversible means comprises a reversible drive motor drivably connected to the spindle and reversing means is provided for each drive motor, each reversing means operable upon the associated rigid member reaching a limit of movement in either direction to reverse the direction of rotation of the drive motor.

* * * * *